US006155521A

United States Patent [19]

O'Hanlon

[11] Patent Number: 6,155,521

[45] Date of Patent: Dec. 5, 2000

[54] BAG HOLDER

[76] Inventor: Frances Parnell O'Hanlon, Alyduke 38 Simmonscourt Castle, Simmonscourt Road Dublin 4, Ireland

[21] Appl. No.: 09/242,571

[22] PCT Filed: Jun. 26, 1998

[86] PCT No.: PCT/IE98/00053

§ 371 Date: Feb. 18, 1999

§ 102(e) Date: Feb. 18, 1999

[87] PCT Pub. No.: WO99/00307

PCT Pub. Date: Jan. 7, 1999

[30] Foreign Application Priority Data

Jun. 27, 1997 [IE] Ireland ..... S970482

[51] Int. Cl.[7] ..... B65B 67/04

[52] U.S. Cl. ..... 248/99; 220/404; 383/33

[58] Field of Search ..... 248/95, 97, 99, 248/100, 914; 383/33; 211/13; 220/318, 319, 320, 908; 141/314, 391; 312/321.5

[56] References Cited

U.S. PATENT DOCUMENTS

| | | | |
|---|---|---|---|
| D. 273,159 | 3/1984 | Adamson et al. | D6/85 |
| 1,922,938 | 8/1933 | Elliott | 248/97 |
| 4,062,604 | 12/1977 | Popper | 248/99 X |
| 4,398,689 | 8/1983 | Prader | 248/99 |
| 4,461,441 | 7/1984 | Briggs | 248/100 |
| 4,487,388 | 12/1984 | Provan | 248/97 |
| 4,858,862 | 8/1989 | Prader | 248/99 |
| 4,998,694 | 3/1991 | Barteaux | 248/100 |
| 5,190,253 | 3/1993 | Sable | 248/97 |
| 5,921,512 | 7/1999 | Torres | 248/99 |
| 6,003,820 | 12/1999 | Baldonado et al. | 248/99 |
| 6,042,063 | 3/2000 | Kerr et al. | 248/100 |

FOREIGN PATENT DOCUMENTS 2519406 8/1983 France .

*Primary Examiner*—Ramon O. Ramirez
*Assistant Examiner*—Tan Le

[57] ABSTRACT

A bag holder device facilitates the reuse of bags such as plastic grocery bags as waste collection bags. The device has a body formed with slots from which the bag can be suspended by means of its handles. An expander element is pivotally connected to the body and is movable between a storage state in which it is folded against the body and a usable state in which it engages the interior of the bag to retain the mouth of the bag open for receiving waste. The device may be removably or non-removably attachable to a support surface or may be free-standing. It is conveniently formed from a washable, lightweight material.

17 Claims, 7 Drawing Sheets

BAG HOLDER

The present invention relates to a device for holding a bag and in particular to such a device for retaining a bag in a usable state as a receptacle.

It is commonplace for supermarkets and the like to provide their customers with bags, usually made from plastics materials, into which purchases are packed. Once the contents have been unpacked, the bags are typically disposed of to waste, and usually this involves placing the bags into a larger, plastics refuse sack which is eventually removed to a public dump. Such bags usually have two handles and are often referred to as "vest" bags.

A known device for holding a bag comprises a housing which has a rear hook element by means of which the housing can be suspended from a cupboard door or the like. The housing projects forwardly and has mounting hooks for receiving the handles of a supermarket bag so as to suspend the bag from the hooks. The device also has a lid for covering the mouth of the suspended bag. This device is relatively bulky and occupies a fixed width from the door.

This invention seeks to reduce amounts of plastics waste by recycling plastic bags as receptacles for waste, thus reducing the need for refuse sacks. The invention further seeks to provide an environmentally-friendly re-use for used plastic bags in a manner which is convenient for the user.

Accordingly, the present invention provides a bag holder device, the device comprising a body having means for retaining the handles of a two-handled bag in a position spaced-apart from one another to suspend the bag from the body and means for engaging a mouth-region of the bag located between the handles so as to hold the mouth in an open state, characterised in that the means for engaging the mouth-region of the bag comprise an expander element which is pivotable relative to the body between a compact, storage state in which the expander element is folded substantially parallel to the flat body and a usable state in which the expander element lies angled away from the body so as to engage the interior of the bag suspended.

Conveniently, the body includes fixing means for connecting the body to a support surface. Preferably, the fixing means comprises means for removably attaching the body to the support surface. In one arrangement, the fixing means comprises a hook element which can be clipped over a door, rail or other surface. Supplementary fixing means may optionally be provided to enable the body to be non-removably connected to the support surface. Alternatively, the body may be connected non-removably to the support surface. In yet another arrangement, the body may be free standing by means of the inclusion in the body of a ground-engaging foot. In any event, it is preferred that spacer means be provided to space the body apart from a support surface from which the bag holder is suspended or to which it is fixed.

Advantageously, the retaining means includes a pair of open-ended slots or tracks formed in the upper edge of the body. In use, one handle of the bag is retained in each slot or track and the handle rests in the base of the slot or track, thereby being prevented from slipping off the body.

The expander element comprises a substantially rigid material shaped and sized to ensure that the mouth of the bag is retained sufficiently widely open so that easy access to the interior of the bag is available. The presence of any sharp edges on the expander element should be avoided, if these are likely to pierce or tear the bag. Stops may be provided on the body to prevent the expander from slipping downwards into the bag.

Advantageously, the device is fabricated from a material which has a surface which can be wiped clean or washed. Plastics material is particularly suitable as it is light and washable, but any other suitable materials, including metal, wood and so on, may also be selected and, where appropriate, may be provided with a surface coating to render it washable. It is particularly suited for use with vest bags, as described above, which bags are commonly supplied to customers by supermarkets and other retailers.

The invention will now be described more particularly with reference to the accompanying drawings which show, by way of example only, one embodiment of a bag holder device according to the invention. In the drawings.

Figure 5:
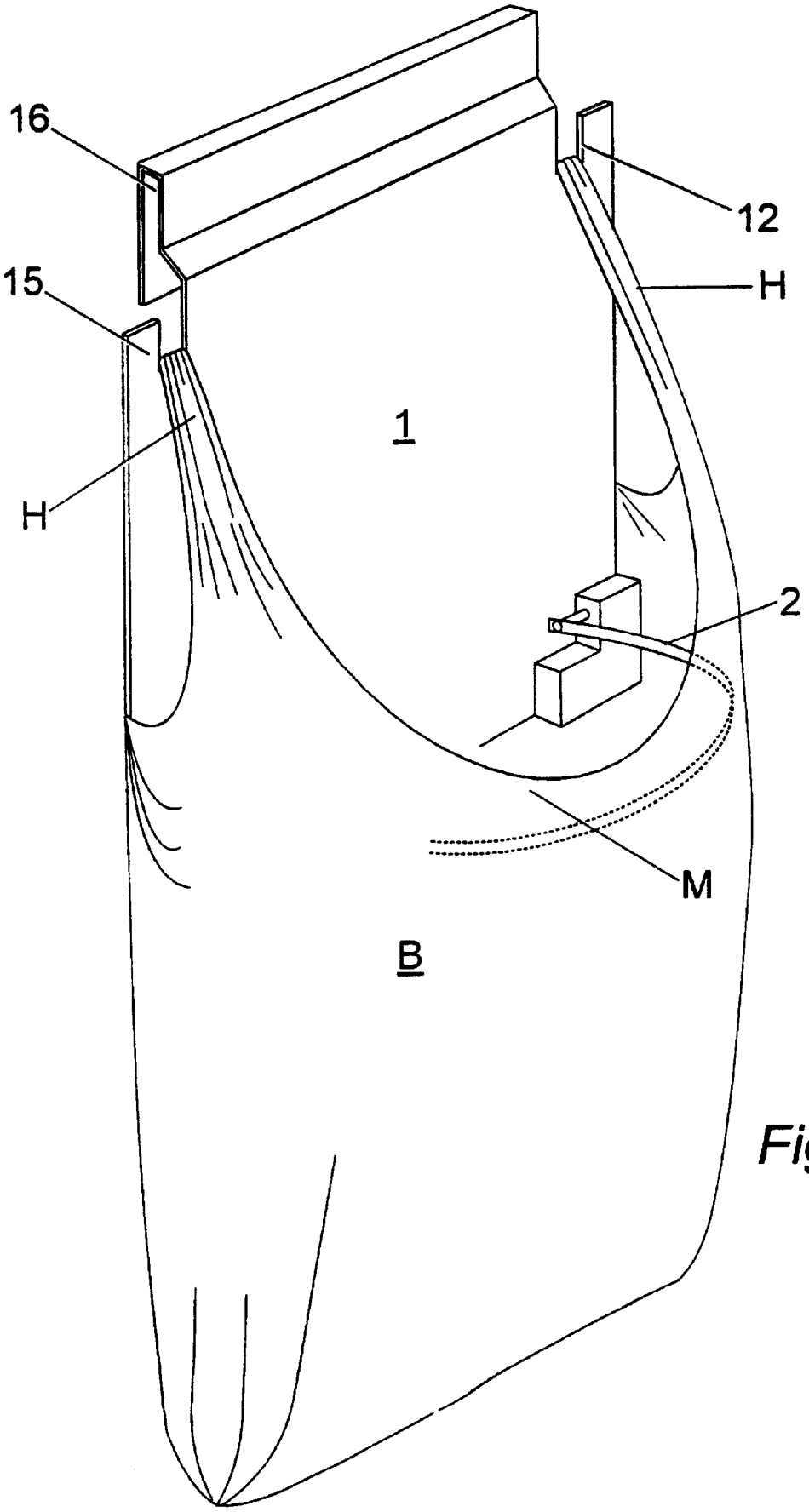
FIG. 5 is a perspective view thereof in the usable state and showing a vest bag retained by the device.

Referring now to FIGS. 1 to 5, the bag holder device comprises a substantially flat bag support body 1 and a bag expander element 2. The expander 2 is pivotally mounted on the body 1 and is movable between a storage state (FIGS. 1 to 4) and a usable state (FIG. 5). In its storage state, the expander 2 lies substantially against and parallel to the planar surface of the body 1 and in its usable state, the expander 2 is pivoted to extend away from and substantially perpendicular to the planar surface of the body 1, to hold the mouth of a bag open.

The body 1 has an upper side 10 and a lower side 11. The upper side 10 is provided with a pair of spaced apart open ended slots 12 which open onto the upper side 10 of the body 1. The slots 12 are integrally formed in the body 1. Between each slot 12 and its nearest edge side 14, the body 1 includes a tab 15. Disposed between the slots 12 and extending upwardly and rearwardly from the upper side 10 is provided a hook element 16. Hook element 16 includes a rearwardly sloped section 16*a* which serves to space the hook element 16 apart from the plane of the body 1.

At its lower side 11, the front face of the body 1 is provided with a pair of spaced apart formations 17 standing proud of its planar surface. Each formation 17 includes a recess 18 for receiving the expander 2. The expander 2 comprises a length of spring wire bent into a loop shape. The free ends 2*a*, 2*b* fit into respective recesses 18 and the expander 2 is sized and shaped so that the ends 2*a*, 2*b* are urged to remain located in the recesses 18, whilst at the same time the fit of the ends 2*a*, 2*b* in the recesses 18 is sufficiently loose to enable the ends 2*a*, 2*b* to rotate within the recesses 18 to permit the expander 2 to pivot relative to the body 1.

Figure 1:
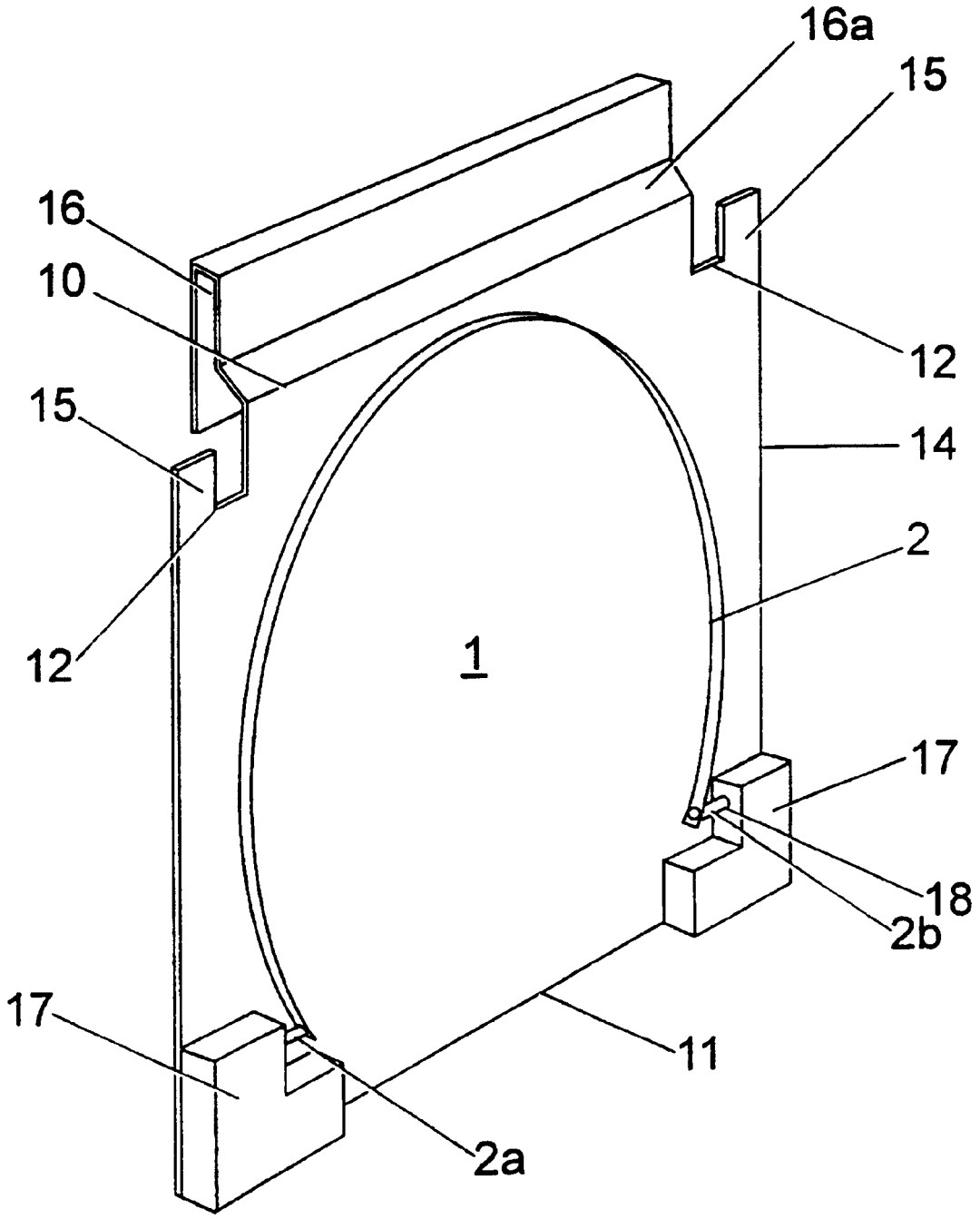
FIG. 1 is a perspective view of a bag holder device in a storage state.
Figure 2:
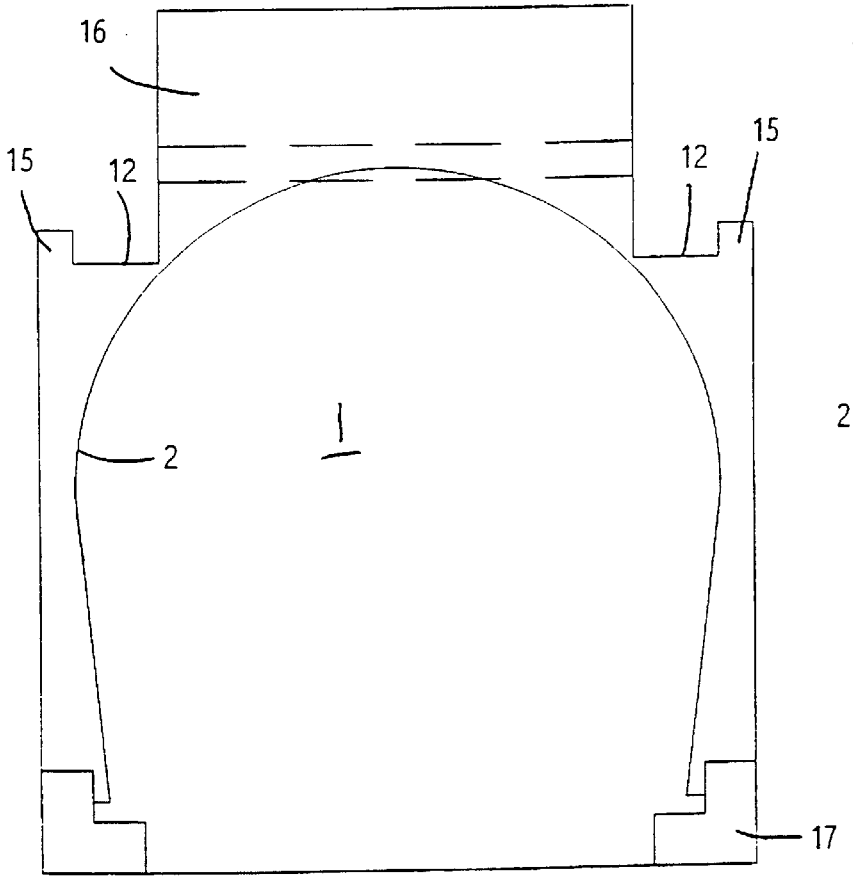
FIG. 2 is a front elevation of the device of FIG. 1.
Figure 4:
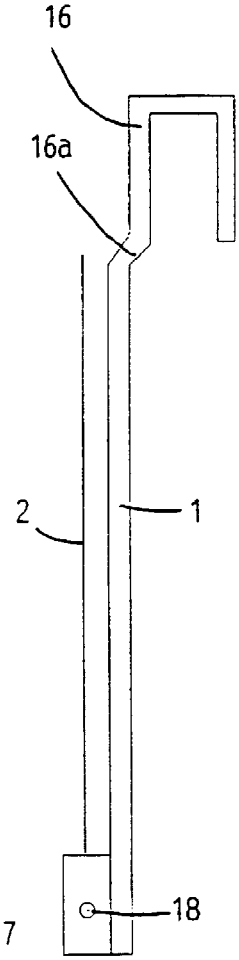
FIG. 4 is a side elevation thereof.
Figure 3:
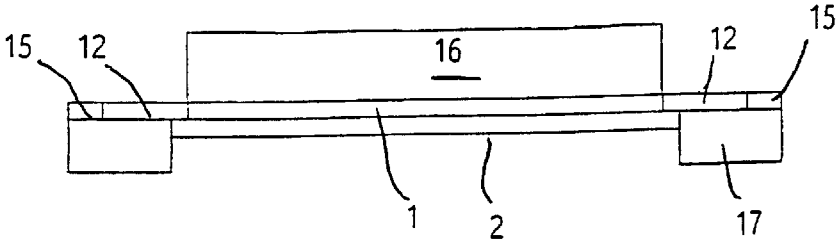
FIG. 3 is a plan view thereof.

The use of the device will now be described with particular reference to FIGS. 1 and 5. The body 1 is attached to a cupboard door, wall, rail or the like. Where appropriate, this may conveniently be achieved by hanging hook element 16 over an appropriate support, such as a door or rail. In cases where it is not appropriate to secure the body 1 to a surface using the hook element 16, the support may be fixed to the surface by a screw or screws or other suitable fixing means (not shown). Even in cases where the hook element 16 is used to fix the body 1 to the door, wall, etc., additional security may be provided by the use of supplementary fixing means. The screw or screws, or other fixing means, may extend through the body 1 or through the hook element 16. However the body 1 is secured, it is preferred that this should be done in such a way so that a clearance is provided between the rearwardly facing surface of the body 1 and any structure behind it. The reason for this will become apparent below.

Once the device has been attached to its support surface it is ready to be used. Any bag which has a pair of spaced apart handles may be used with the device. The bag may be made of paper or other suitable material capable of withstanding the waste or other material which the bag must accept in use. Most preferably, the bag is fabricated from plastics material and is formed with a pair of opposed handles which are upstanding from the mouth M of the bag. Such a "vest" bag B is depicted in FIG. 5.

Bag B is slipped onto the device by introducing the bag B over the body 1 from below with the bag handles H leading. The bag is drawn up from below the body 1 so that the mouth of the bag passes over the body 1. That is to say, the back of the bag passes behind the body 1 and the front of the bag passes in front of the body 1. To assist the user in placing the bag in this way, the body 1 is arranged, as described above, to stand clear of any surface or structure behind it. In particular, the lower surface 11 of the body 1 should stand proud to enable the user freely to slip the bag over the body 1.

When the bag B has been drawn over the body 1, it is secured thereon by leading the handles over the tabs 15 and into the slots 12. The tabs 15 serve to prevent the handles H slipping sideways off the body 1. The bag B is now held suspended from the body 1 with the mouth of the bag extending between the slots 12. Generally, the separation of the slots 12 is chosen so that the bag mouth is slack between the handles.

Once the bag B is placed about the body 1, the expander 2 is deployed expand the mouth M of the bag B and to retain the mouth M open for the receipt of waste or other material. This is achieved by pivoting the expander 2 from the storage position shown in FIG. 1 to the usable position depicted in FIG. 5. In the latter position, the expander 2 abuts the upper side of the interior of the front of the bag to retain the mouth M open.

The bag is now available to receive materials. Once filled, it is removed from the device and a fresh bag is fitted. Alternatively, the bag may be pre-filled with materials, which are removed as required. In this case, the bag is removed when empty and replaced by a filled bag.

In particular, the device is suited for use with plastic bags commonly supplied by supermarkets and grocery shops. Generally these bags are discarded after they have served their primary purpose of facilitating the movement of purchases from shop to home. The invention provides a relatively inexpensive device which can easily and conveniently be used to provide an attractive alternative to the commonplace practice of discarding the bags to waste once their primary purpose has been exhausted.

Figure 6:
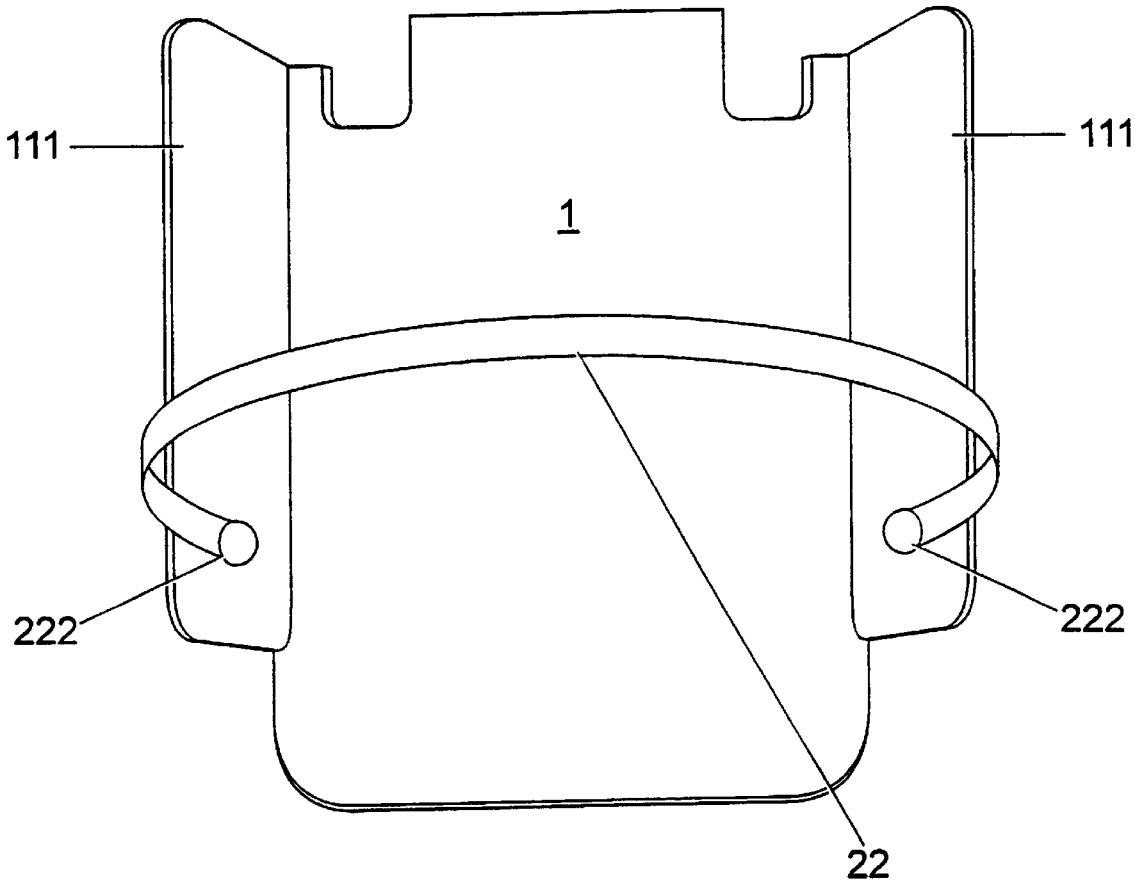
FIG. 6 is a front elevation of a second embodiment of the device.

FIG. 6 shows a second embodiment of the device in which the expander 22 comprises a band of rigid or substantially rigid, yet flexible material in a fixed curved shape. The band 22 is pivotally fixed to the body 1 by rivets 222 attached to forwardly extending wings 111 of the body 1.

Figure 7:
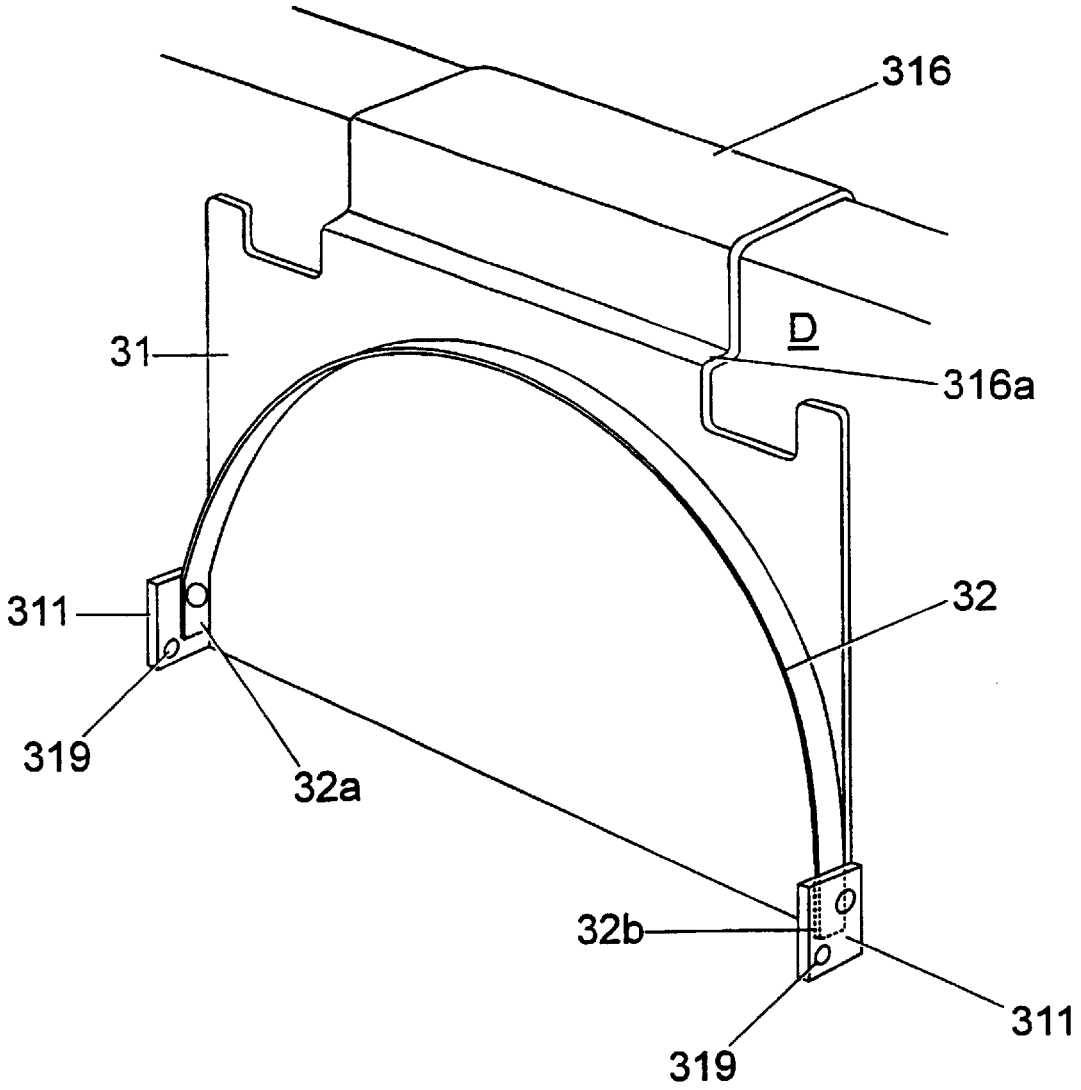
FIG. 7 is a perspective view of a third embodiment of the device, shown suspended from a door.
Figure 8:
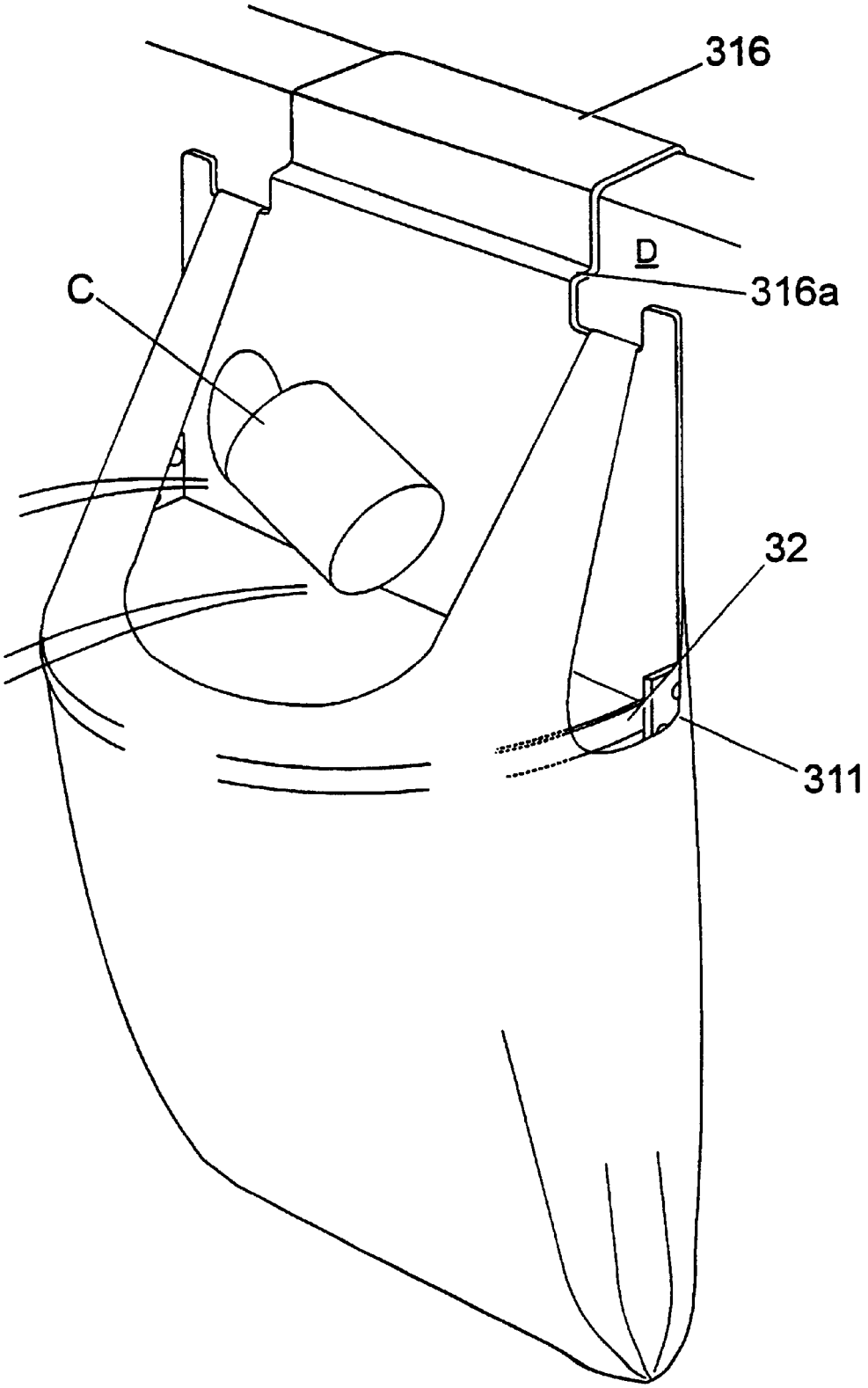
FIG. 8 is a view of the device of FIG. 7 with a vest bag suspended therefrom.

FIGS. 7 and 8 depict a third embodiment of a bag holder in which an expander 32 similar to the flexible, rigid band 22 of FIG. 6 is used. Expander 32 is attached to forwardly extending projections 311 which are attached to the body 31. Each projection 311 has an aperture therein for receiving the free end 32*a* or 32*b* of the expander 32 by bolts, rivets or other suitable means in such fashion that the expander 32 is free to swing between a vertical position when not in use and a horizontal position for holding a bag open. A stop or stud 319 is provided on each projection 311 below and forwardly of the aperture for preventing the expander 32 from falling down beyond the substantially horizontal position shown in FIG. 8 in which it retains the mouth of a suspended bag B open for receipt of waste such as a tin can C. The body 31 is suspended from a door D by hook element 316 which includes spacer 316*a*.

Figure 9:
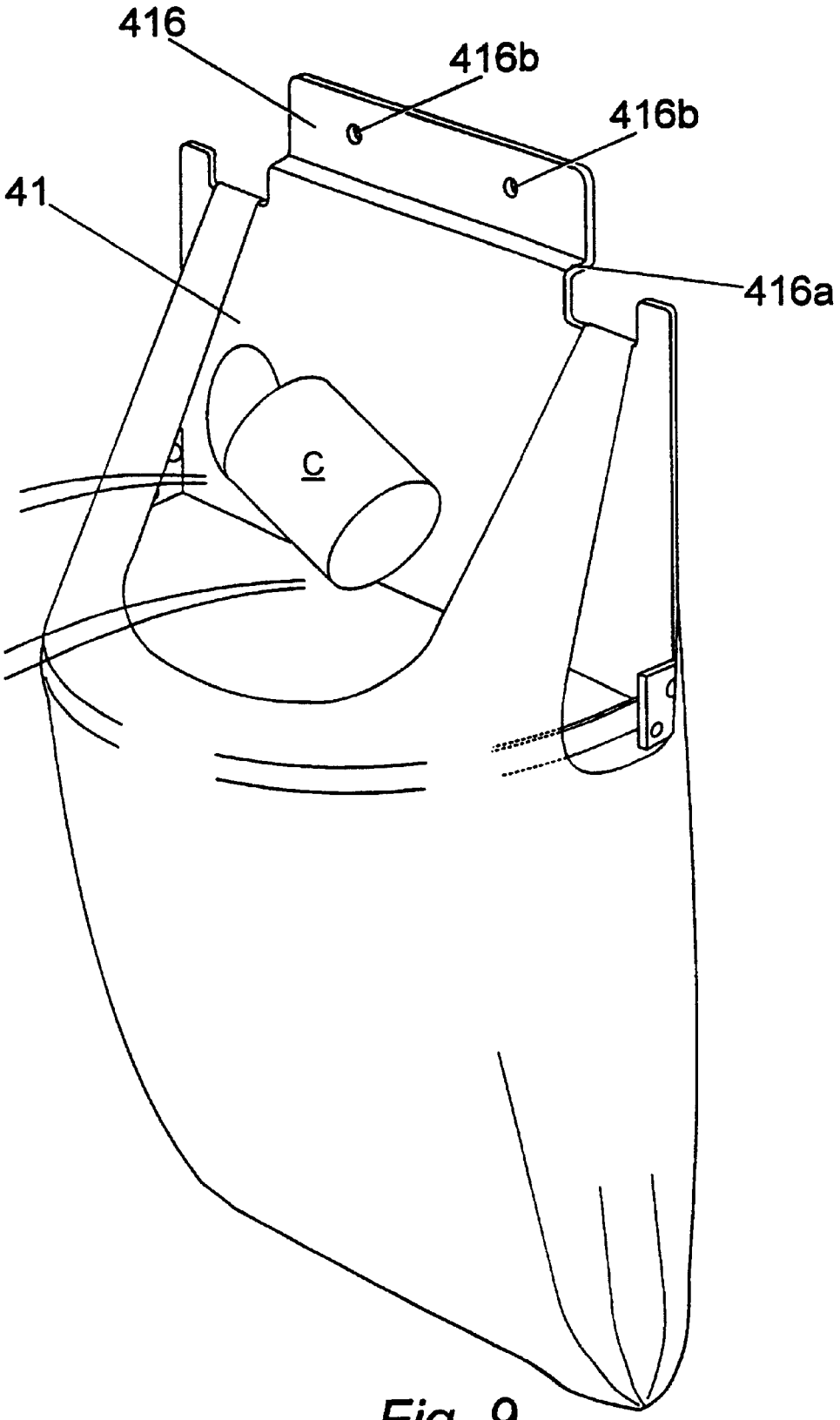
FIG. 9 is a perspective view of a fourth embodiment of the device, with a vest bag suspended therefrom.

A fourth embodiment of a bag holder device is shown in FIG. 9. This embodiment is identical to that of FIGS. 7 and 8, except in that in place of a hook element, the body 41 is provided with a fixing plate 416 which can be connected to a support surface by screws or the like which engage in apertures 416*b*. As with the embodiment of FIGS. 7 and 8, the device of FIG. 7 is provided with a horizontal spacer element 416*a* to space the body 41 apart from the support surface, thereby to facilitate a user in suspending a bag from the device.

The body may be fabricated from any suitable material including metal, wood, plastics material and so on. Most preferably, the body is fabricated from a washable plastics material. Similarly, the expander element is preferably composed of a washable material or of a material which is covered by a washable surface coating.

The suspension hook element may be omitted from the device and the body may be removably or non-removably fixed to the door, wall or other support surface by means such as screws or the like. However, it is preferred that the device be removably attachable to facilitate its removal for cleaning. It is also envisaged that the device may be provided as a free standing unit which need not be attached to any support surface. For this purpose, the body may be provided upstanding from the ground-engaging foot.

Where the device is intended to be attached, removably or non-removably, to a door or the like, it is preferred that it should be arranged so that at least the lower side of the body stands clear of the door or the like so as not to interfere with the placement of the bag.

It will of course be understood that the invention is not limited to the specific details described herein, which are given by way of example only, and that various modifications and alterations are possible within the scope of the invention as defined in the appended claims.

What is claimed is:

1. A bag holder device comprising a body having means for retaining the handles of a two-handled bag in a position spaced-apart from one another to suspend the bag from the body and means for engaging a mouth-region of the bag located between the handles so as to hold the mouth in an open state, characterized in that the means for engaging the mouth-region of the bag comprise an expander element which is pivotable relative to the body between a compact, storage state in which the expander element is folded substantially parallel to the body and a usable state in which the expander element lies angled away from the body so as to engage the interior of the bag suspended from the retaining means and to hold the mouth thereof open;

wherein the expander element comprises a portion of an arcuate loop terminating in spaced ends, the spaced ends being pivotally mounted on the body, and wherein the arcuate loop of the expander element is continuous along the loop between the ends.

2. A device as claimed in claim 1, in which the expander element comprises a substantially rigid material shaped and sized to ensure that the mouth of the bag is retained sufficiently widely open so that easy access to the interior of the bag is available.

3. A device as claimed in claim 2, in which the expander element is free of any sharp edge which might pierce or tear the bag.

4. A device as claimed in claim 1, in which the body is substantially flat.

5. A device as claimed in claim 1, in which the body includes a fixing means for connecting the body to a support surface.

6. A device as claimed in claim 5, in which the fixing means comprises means for removably attaching the body to the support surface.

7. A device as claimed in claim 6, in which the fixing means comprises a hook element which can be clipped over a door, rail or other surface.

8. A device as claimed in claim 5, including a spacer means for spacing the body apart from the support surface for permitting at least a portion of the body into the interior of the bag.

9. A device as claimed in claim 1, including a supplementary fixing means for enabling the body to be non-removably connected to a support surface.

10. A device as claimed in claim 1, in which the retaining means includes a pair of open-ended slots formed in an upper edge of the body.

11. A device as claimed in claim 1, which is fabricated from a material which has a washable surface.

12. A device as claimed in claim 1, in which the body is provided with a stop means for preventing the expander element from pivoting downwardly beyond a substantially perpendicular position with respect to the body and into the interior of a suspended bag.

13. A bag holder device for supporting a bag having a mouth region and a pair of handle apertures located adjacent to the mouth region of the bag at substantially opposite locations on the bag, the bag holder device comprising:

a body having spaced-apart hook portions for engaging each of the handles of the bag to suspend the bag from the body; and an expander element for engaging a mouth-region of the bag located between the handles so as to hold the mouth in an open state, the expander element being mounted on the body in a manner such that the expander element is pivotable relative to the body, the expander element being pivotable between a usable state and a compact, storage state, the usable state being characterized by the expander element extending away from the body so as to engage an interior of the bag suspended from the hook portions for holding the mouth region of the bag in an open condition, and the compact, storage state being characterized by the expander element being folded upward into a position substantially parallel and adjacent to the body so that the mouth of the bag suspended from the hook portions is positioned adjacent to the body and capable of being opened by hand for access to the interior of the bag.

14. The device of claim 13 wherein the expander element comprises a portion of an arcuate loop terminating in spaced ends, the spaced ends being pivotally mounted on the body.

15. The device of claim 14 wherein the hook portions are located on an upper section of the body and the mounting location of the spaced ends on the body are located on a lower section of the body such that the lower section of the body is inserted into the interior of the bag when the handle apertures of the bag are hooked on the hook portions of the upper section.

16. The device of claim 14 wherein a first axis extends through each of the spaced hook portions, and a second axis extends through each of the spaced ends of the arcuate loop of the expander element, and wherein the first and second axes are substantially parallel and spaced from each other such that the expander element is positioned between the first and second axes when in the compact, storage state.

17. The device of claim 14 wherein the arcuate loop of the expander element is continuous along the loop between the ends.

* * * * *